US005498137A

United States Patent [19]

El-Aini et al.

[11] Patent Number: 5,498,137

[45] Date of Patent: Mar. 12, 1996

[54] TURBINE ENGINE ROTOR BLADE VIBRATION DAMPING DEVICE

[75] Inventors: Yehia M. El-Aini, Jupiter; Joseph C. Burge, Palm Beach Gardens; Carl E. Meece, Jupiter, all of Fla.

[73] Assignee: United Technologies Corporation, Hartford, Conn.

[21] Appl. No.: 390,347

[22] Filed: Feb. 17, 1995

[51] Int. Cl.[6] ..... F01D 5/14

[52] U.S. Cl. ..... 416/229 A; 416/144; 416/500

[58] Field of Search ..... 416/500, 229, 416/232, 241 R, 144

[56] References Cited

U.S. PATENT DOCUMENTS

| | | | |
|---|---|---|---|
| 2,462,962 | 3/1949 | Harker | 170/159 |
| 2,514,140 | 7/1950 | O'Connor | 188/1 |
| 2,689,107 | 9/1954 | Odegaard | 416/229 A |
| 2,984,453 | 5/1961 | Heymann | 416/229 A |
| 2,999,669 | 9/1961 | McGinnis | 416/229 A |
| 3,754,838 | 8/1973 | Fu et al. | 416/145 |
| 3,966,357 | 6/1976 | Corsmeier | 416/500 |
| 4,118,147 | 10/1978 | Ellis | 416/230 |
| 5,056,738 | 10/1991 | Mercer et al. | 416/500 |
| 5,232,344 | 8/1993 | El-Aini | 416/145 |
| 5,273,398 | 12/1993 | Reinfelder et al. | 416/144 |
| 5,356,264 | 10/1994 | Watson et al. | 416/500 |
| 5,407,321 | 4/1995 | Rimkunas et al. | 416/500 |

FOREIGN PATENT DOCUMENTS

| | | | |
|---|---|---|---|
| 1024218 | 3/1953 | France . | |
| 1272169 | 4/1972 | Germany . | |
| 0181794 | 8/1986 | Japan | 416/500 |
| 0114688 | 8/1945 | Sweden | 416/500 |

*Primary Examiner*—Thomas E. Denion
*Assistant Examiner*—Mark Sgantzos
*Attorney, Agent, or Firm*—Richard D. Getz

[57] ABSTRACT

A rotor blade for a turbine engine rotor assembly is provided comprising a root, an airfoil, a platform, and apparatus for damping vibrations in the airfoil. The airfoil includes a pocket formed in a chordwise surface. The apparatus for damping vibrations in the blade includes a damper and a pocket lid. The damper is received within the pocket between an inner surface of the pocket and the pocket lid. The pocket lid is attached to the airfoil by conventional attachment apparatus and contoured to match the curvature of the airfoil.

12 Claims, 2 Drawing Sheets

TURBINE ENGINE ROTOR BLADE VIBRATION DAMPING DEVICE

BACKGROUND OF THE INVENTION

1. Technical Field

This invention applies to turbine engine rotor assemblies in general, and to apparatus for damping vibration within turbine engine rotor assemblies in particular.

2. Background Information

Turbine and compressor sections within an axial flow turbine engine generally include a rotor assembly comprising a rotating disk and a plurality of rotor blades circumferentially disposed around the disk. Each rotor blade includes a root, an airfoil, and a platform positioned in the transition area between the root and the airfoil. The roots of the blades are received in complementary shaped recesses within the disk. The platforms of the blades extend laterally outward and collectively form a flow path for fluid passing through the rotor stage.

During operation, turbine engine rotor assemblies rotate at a variety of speeds through fluid that varies in temperature, pressure, and density. As a result, the blades may be excited in a number of different modes of vibration. Lower order modes, such as the first bending mode and first torsion mode, are generally predictable enough such that a single style damper may be implemented throughout the rotor assembly. For instance, a particular style damper may be implemented against the blade platforms of adjacent blades to damp lower order vibration.

Higher order modes of vibration, on the other hand, are more difficult to damp. Upstream airfoils within a multiple stage rotor assembly, for example, can create aerodynamic wakes that cause downstream airfoils to experience higher order modes of vibration such as plate deformation. Plate deformation, predominantly in the form of chordwise bending, often manifests in upper regions of the airfoil in a non-symmetrical pattern and is accordingly difficult to predict in terms of magnitude and position.

What is needed, therefore, is an apparatus and/or a method for damping higher order modes of vibration in a blade of a rotor assembly.

DISCLOSURE OF THE INVENTION

It is, therefore, an object of the present invention to provide a rotor blade for a turbine engine rotor assembly that includes means for damping higher order modes of vibration.

It is another object of the present invention to provide means for damping vibration in a rotor blade which minimizes disturbance of air flow adjacent the rotor blade.

It is still another object of the present invention to provide means for damping vibration in a rotor blade which does not negatively affect the structural integrity of the rotor blade.

It is a still another object of the present invention to provide means for damping vibration in a rotor blade which has an increased resistance to wear.

It is still another object of the present invention to provide means for damping vibration in a rotor blade which can be installed easily and in a cost-efficient manner.

It is still another object of the present invention to provide means for damping vibration in a rotor blade that can be tailored and positioned in the blade to counteract specific vibratory conditions.

According to the present invention, a rotor blade for a turbine engine rotor assembly is provided comprising a root, an airfoil, a platform, and means for damping vibrations in the airfoil. The airfoil includes a pocket formed in a chordwise surface. The means for damping vibrations in the blade includes a damper and a pocket lid. The damper is received within the pocket between an inner surface of the pocket and the pocket lid. The pocket lid is attached to the airfoil by attachment means and contoured to match the curvature of the airfoil. Relative movement between the pocket, pocket lid, and damper causes vibrational movement to be damped and dissipated in the form of frictional energy.

According to one aspect of the present invention, the damper is a sinusoidal shaped member biased between the pocket and the pocket lid.

According to another aspect of the present invention, the damper is a plurality of strands formed in a mesh which is received within the pocket.

According to still another aspect of the present invention, the pocket lid includes means for locating the damper within the pocket. The locating means maintains the damper in a particular area of the pocket and prevents the damper from interfering with the attachment means.

According to still another aspect of the present invention, a method for damping higher order modes of vibration in a rotor blade for a turbine engine rotor assembly is provided.

One advantage of the present invention is that means for damping vibrations in a rotor blade is provided which minimizes air flow disturbance adjacent the rotor blade. Minimizing turbulent air flow within a rotor assembly is critical both performance-wise and to prevent undesirable forcing functions downstream and the vibrations that often accompany them.

Another advantage of the present invention is that the means for damping vibrations has minimal effect on the structural integrity of the rotor blade. A person of skill in the art will recognize that it is known to have a hollow rotor blade and damping means positioned within the hollow. Hollow rotor blades are either cast hollow or are cast in halves and subsequently joined by a welding process such as inertia welding. One piece cast hollow blades must include an opening sufficient to accommodate the damping device. The opening and the accompanying increased volume of the hollow generally decrease the blade's stress tolerance. Seamed hollow blade halves allow an internal pocket to be formed without the access hole, but have the disadvantage of having a seam about the periphery of the entire blade and whatever residual weld material is extruded into the internal pocket. Both the seam and the excess weld material are stress risers that adversely affect the resistance to stress. The present invention, on the other hand, allows the blade to be formed as a single piece and only the material necessary for the pocket is subsequently removed.

Still another advantage of the present invention is that biasing (i.e. preloading) the damper in the pocket decreases the frictional wear on the damper. The prior art discloses enclosing one piece solid slugs or a plurality of shims in an internal pocket within a seamed blade. A disadvantage to these approaches is that the loose pieces within the pocket(s) tend to move more within the pocket(s) and therefore frictionally wear at a pace greater than that of the biased damper of the present invention.

Still another advantage of the present invention is that the damper is enclosed within the pocket and therefore not subject to the harsh external environment. The fluids drawn through the rotor assembly expose the airfoil external surfaces to foreign elements and corrosive conditions precipitated by the high temperature and composition of the fluid. The present assembly insulates the damper from these undesirable external conditions and therefore maximizes the useful life of the damper.

Still another advantage of the present invention is that the means for damping vibration in a rotor blade can be installed easily and in a cost-efficient manner. Joining rotor blade halves, and installing a damping means therebetween, adds significant difficulty, and therefore cost, to the manufacturing process of the rotor blades.

Still another advantage of the present invention is that the means for damping vibration in a rotor blade can be tailored and positioned in the blade to counteract specific vibratory conditions in particular blades. Cast hollow rotor blades must define the position of the damping device prior to vibration testing that particular blade. Moreover, cast hollow blades must also include passage through the blade to the position. Consequently, the pocket geometry and/or position may not always be the optimum geometry and/or in the optimum position. Seamed rotor blade halves similarly may not have the optimum internal pocket geometry or position and in addition, may not have the optimum damping device since the device must be inserted before the halves are seamed. The present invention, on the other hand, permits the blade to be tested first and subsequently have a damping means properly chosen and installed if necessary. In other words, specific unsymmetrical higher order vibratory conditions can be identified and then accommodated using the present invention.

These and other objects, features and advantages of the present invention will become apparent in light of the detailed description of the best mode embodiment thereof, as illustrated in the accompanying drawings.

BEST MODE FOR CARRYING OUT THE INVENTION

Figure 2:
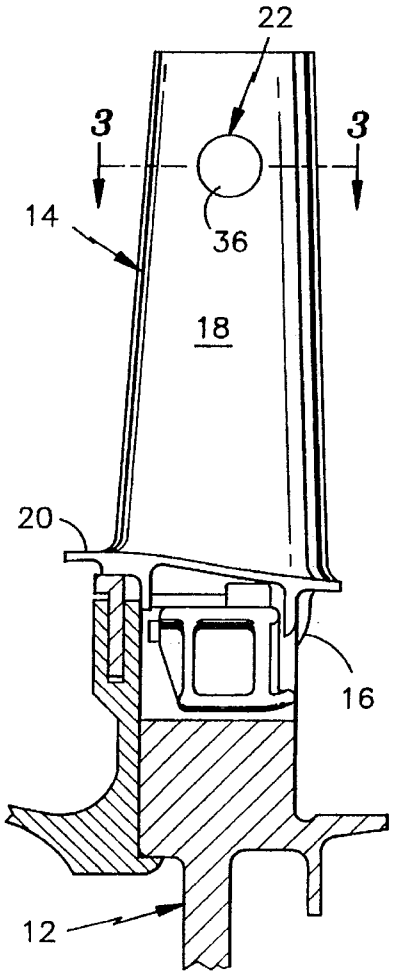
FIG. 2 is a sectional view of the rotor assembly shown in FIG. 1.
Figure 1:
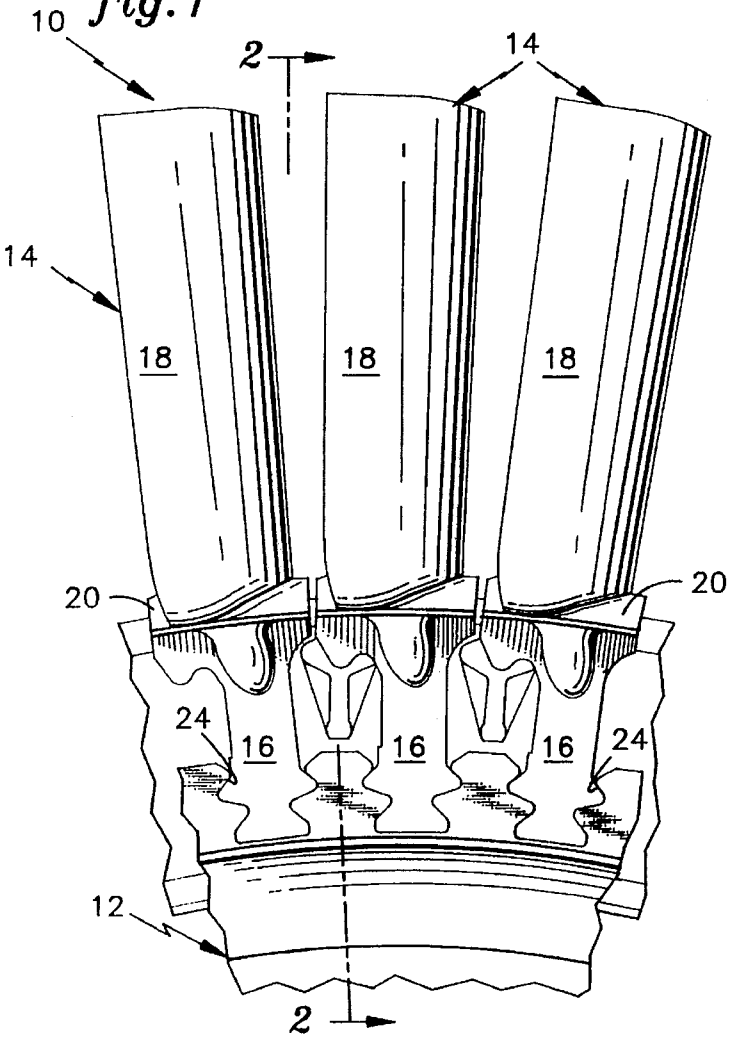
FIG. 1 is a partial view of a rotor assembly.

Referring to FIG. 1, a rotor assembly 10 for a turbine engine is partially shown. The rotor assembly 10 includes a rotating disk 12 and a plurality of rotor blades 14 circumferentially disposed around the disk 12. Each rotor blade 14 includes a root 16, an airfoil 18, a platform 20 positioned in the transition area between the root 16 and the airfoil 18, and means 22 (see FIGS. 2 and 3A–3C) for damping vibrations in the blade 14. The roots 16 are received within complimentary shaped recesses 24 in the disk 12. Each airfoil 18 includes a pocket 26 (see FIGS. 3A–3C) for receiving the means 22 for damping vibrations. The pocket 26 is disposed in a chordwise face 28 of the airfoil 18 and is defined as having sidewalls 30 and an inner surface 32.

Figure 3A:
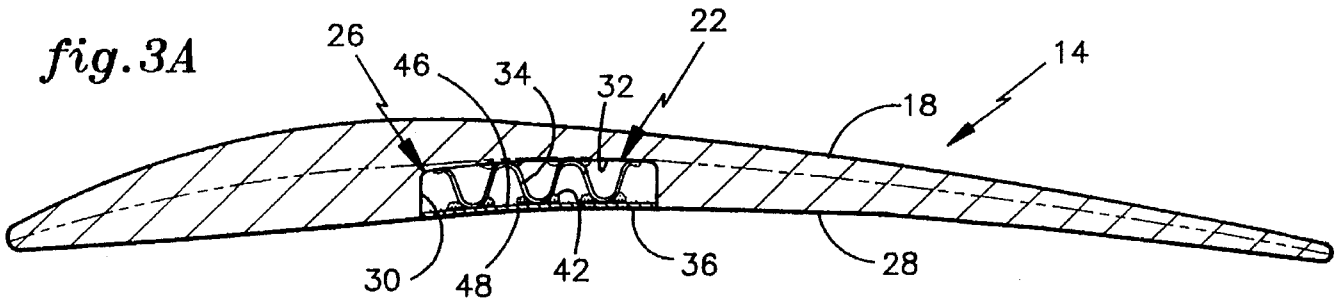
FIGS. 3A, 3B, and 3C are cross-sectional view of the rotor blade shown in FIG. 2
Figure 3B:
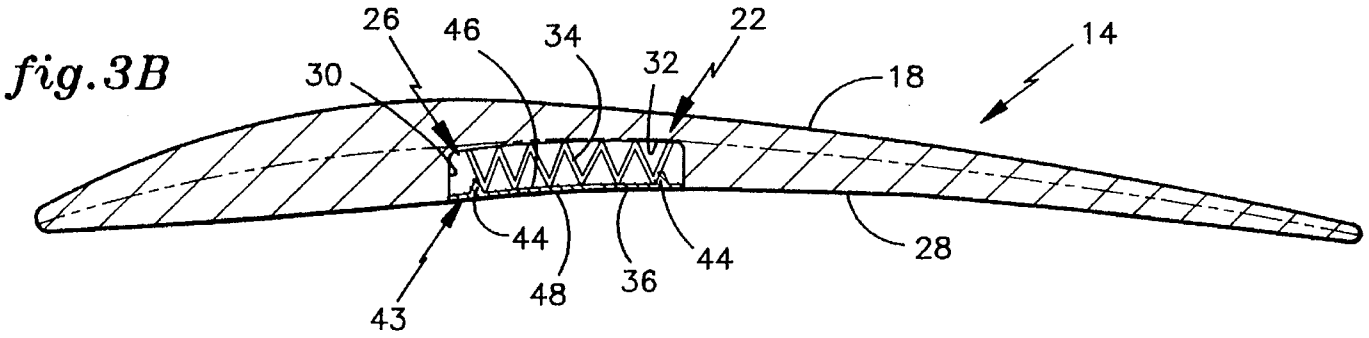
Figure 3C:
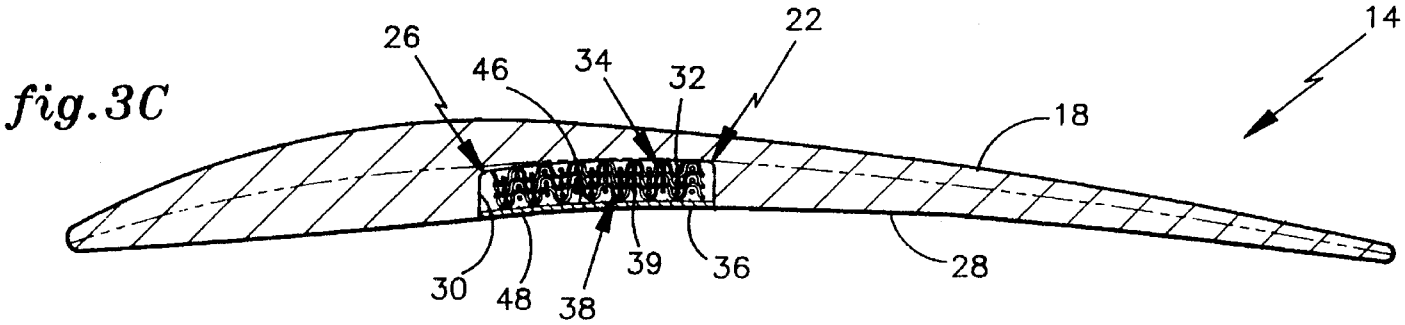

Referring to FIGS. 3A–3C, the means 22 for damping vibrations includes a damper 34 and a pocket lid 36. The damper 34 is received within the pocket 26 and maintained there by the pocket lid 36. In a first embodiment, the damper 34 comprises an element formed in a sinusoidal shape having an amplitude and a period, as is shown in FIG. 3A. Different amplitudes and periods may be implemented as is necessary to alter the amount of surface area in contact and the magnitude of the frictional contact between the damper 34 and the inner surface 32 of the pocket 26 and between the damper 34 and the pocket lid 36. In addition, corrugations having other than a sinusoidal shape may be used alternatively (see FIG.3B). In a second embodiment, the damper 34 comprises a mesh 38 of strands 39. The mesh strands 39 provide contact not only with the pocket 26 and the lid 36, but also between the strands 39 within the mesh 38. In either or both embodiments, a coating 42, such as a copper alloy or a dry film lubricant, may be implemented at the friction points to promote the dissipation of energy and to minimize the wear.

Referring to FIG. 3B, the pocket lid 36 is a metallic element having a shape complimentary to the opening of the pocket 26. The pocket lid 36 may include means 43 for centering the damper 34. The means 43 for centering the damper 34 includes tabs 44 formed in, or attached to, the pocket lid 36 that maintain the damper 34 in a particular area of the pocket 26.

During the manufacturing of the rotor blades 14, each blade, or a representative sample of the total number, are examined to determine the blade's vibratory characteristics. Specifically, a number of methodologies, such as impact testing, holography, and stress pattern analysis by thermal emission (SPATE), are employed to ascertain the blade's fundamental frequencies and modes of vibration. In the case of higher order modes of vibration where the modes may not manifest in symmetrical patterns and are therefore less predictable, the methodologies are employed to determine the position and magnitude of the modes.

The next step in the manufacturing process of the blades 14 is to establish if a damping means 22 is required in the blade 14 being evaluated. If the blade's 14 natural frequencies coincide with the potential excitation frequencies, then a damping means 22 will generally be required to minimize the stress effects on the blade 14 caused by the vibration. The required capacity and position of the damping means 22 are determined using the information developed in the vibration analysis of the blade 14. Specifically, the modes of vibration and the nodal lines thereof will indicate what vibratory amplitudes can be expected at what position. The pocket 26 geometry is chosen and located to intersect regions of higher vibratory amplitudes where the damping will be most effective, without significantly adding to the stress characteristics of the blade 14. In the preferred embodiment, the pocket sidewalls 30 define a circular shape and the inner surface 32 defines the base of the pocket 26, located in the upper regions of a chordwise surface 28 of the blade 14. The circular shape is advantageous for machining purposes, but other geometries may be used alternatively.

In the next step of the manufacturing process, a damper 34 is selected which will adequately damp the blade 14 vibrations within the problematic frequencies and modes determined earlier. The damper 34 is received within the pocket 26 and the pocket lid 36 is welded adjacent the opening of the pocket 26 thereby closing the pocket 26 and maintaining the damper 34 therein. The dimension between the inner surface 32 of the pocket 26 and the inner surface 46 of the pocket lid 36 is chosen to effectuate whatever preload (i.e. bias) is desired on the damper 34, if preload is used. In the case of the mesh 38 type damper 34 (FIG.3C), it may be desirable to minimize or eliminate preload on the damper. In either case, damping will occur at least between the damper 34 and the pocket 26 via friction caused by the friction coefficients of the elements 26,34 and the centrifugal normal force exerted when the rotor assembly rotates. After the lid 36 is secured, the exterior surface 48 of the lid 36 is contoured to agree with the curvature of the airfoil 18.

Although this invention has been shown and described with respect to the detailed embodiments thereof, it will be understood by those skilled in the art that various changes in form and detail thereof may be made without departing from the spirit and scope of the claimed invention.

We claim:

1. A rotor blade for a turbine engine rotor assembly, comprising:

a root, for attaching said blade to a disk of the rotor assembly;

an airfoil, having a pocket formed in a chordwise surface, said pocket open to said surface;

a platform, extending outward from said blade in a transition area between said root and said airfoil; and means for damping vibrations in said blade, said means including a damper; and a pocket lid;

wherein said damper is received within said pocket and biased between an inner surface of said pocket and said pocket lid, said pocket lid attached to said airfoil by attachment means and contoured to match the curvature of said airfoil.

2. A rotor blade according to claim 1, wherein said pocket lid further comprises means for locating said damper within said pocket, said locating means restricting motion of said damper in said pocket.

3. A rotor blade according to claim 1, wherein said damper comprises a sinusoidal shape, said damper contacting said pocket lid and said inner surface of said pocket at a plurality of points;

wherein vibration of said blade causes motion of said blade relative to said damper, and therefore damping of said motion due to friction between said damper and said blade.

4. A rotor blade according to claim 3, wherein said pocket lid further comprises means for locating said damper within said pocket, said locating means restricting motion of said damper in said pocket.

5. A rotor blade according to claim 2, wherein said damper comprises a plurality of strands formed in a mesh, said mesh contacting said pocket lid and said inner surface of said pocket at a plurality of points;

wherein vibration of said blade causes motion of said blade relative to said damper, and motion of said strands relative to one another, and therefore damping of motion between said blade and said damper due to friction between said damper and said blade, and friction between said strands.

6. A rotor blade assembly for a turbine engine, comprising:

a plurality of rotor blades, each blade including:

a root;

an airfoil, having a pocket formed in a chordwise surface, wherein said pocket is open to said surface;

a platform, extending outward from said blade in a transition area between said root and said airfoil; and means for damping vibrations in said blade, said means including a damper; and a pocket lid;

wherein said damper is received within said pocket and biased between an inner surface of said pocket and said pocket lid, said pocket lid attached to said airfoil by attachment means and contoured to match the curvature of said airfoil;

a disk, having an outer surface which includes a plurality of complementary recesses circumferentially distributed around said disk, for receiving said blade roots.

7. A rotor blade assembly according to claim 6, wherein said pocket lid further comprises means for locating said damper within said pocket, said locating means restricting motion of said damper in said pocket.

8. A rotor blade assembly according to claim 6, wherein said damper comprises a sinusoidal shape, said damper contacting said pocket lid and said inner surface of said pocket at a plurality of points;

wherein vibration of said blade causes motion of said blade relative to said damper, and therefore damping of said motion due to friction between said damper and said blade.

9. A rotor blade assembly according to claim 8, wherein said pocket lid further comprises means for locating said damper within said pocket, said locating means restricting motion of said damper in said pocket.

10. A rotor blade assembly according to claim 7, wherein said damper comprises a plurality of strands formed in a mesh, said mesh contacting said pocket lid and said inner surface of said pocket at a plurality of points;

wherein vibration of said blade causes motion of said blade relative to said damper, and motion of said strands relative to one another, and therefore damping of motion between said blade and said damper due to friction between said damper and said blade, and friction between said strands.

11. A method for damping vibrations in a rotor blade of a turbine rotor assembly, comprising the steps of:

(a) providing a rotor blade having:

a root;

an airfoil;

a platform, extending outward from said blade in a transition area between said root and said airfoil; and means for damping vibrations in said blade, said means including a damper; and a pocket lid;

(b) determining the vibratory characteristics of said rotor blade, including determining where nodal lines exist for higher order modes of vibration within said airfoil, and where high stress regions exist within said airfoil;

(c) determining an optimum geometry for a pocket formed in a chordwise surface of said airfoil, such that said pocket does not intersect said nodal lines and said high stress regions within said airfoil;

(d) forming said pocket in said chordwise surface;

(e) installing said damper in said pocket and attaching said pocket lid;

(f) selectively contouring said pocket lid to assume the curvature of said airfoil.

12. A method according to claim 11, further comprising the steps of:

providing means for locating said damper in said pocket, said means attached to said pocket lid;

wherein said locating means restricts motion of said damper in said pocket.

* * * * *